US007487965B2

(12) United States Patent
Stemmle

(10) Patent No.: US 7,487,965 B2
(45) Date of Patent: Feb. 10, 2009

(54) MULTI-SHEET IN-LINE DEFORMATION BINDING APPARATUS

(75) Inventor: Denis J. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 529 days.

(21) Appl. No.: 11/187,462

(22) Filed: Jul. 22, 2005

(65) Prior Publication Data

US 2007/0018379 A1 Jan. 25, 2007

(51) Int. Cl.
*B65H 31/26* (2006.01)

(52) U.S. Cl. ..... 271/220; 271/241; 271/176; 271/207; 53/569

(58) Field of Classification Search ..... 271/176, 271/207, 220, 241; 53/460, 569, 540, 51; 414/788.9, 795.7; 493/93, 99, 186, 197, 493/216, 917; 198/608, 624, 459.6, 531; 270/58.12, 58.27, 58.17
See application file for complete search history.

(56) References Cited

U.S. PATENT DOCUMENTS 4,905,979 A * 3/1990 Limbach et al. ..... 271/176
6,293,543 B1 * 9/2001 Lawrence ..... 271/213
6,722,646 B2 * 4/2004 Sekiyama et al. ..... 270/58.09

FOREIGN PATENT DOCUMENTS

JP 04350060 A * 12/1992

* cited by examiner

*Primary Examiner*—Patrick H Mackey
*Assistant Examiner*—Gerald W McClain
(74) *Attorney, Agent, or Firm*—Brian A. Collins; Angelo N. Chaclas

(57) ABSTRACT

An apparatus for fabricating a multi-sheet mailpiece including a compiler, and axial and radial deformation binding mechanisms. The compiler includes a sheet feeding apparatus and registration device for accepting multiple individual sheets. The sheet feeding apparatus lays the sheets onto a compiler tray to form a multi-sheet stack having face sheets and content sheets disposed therebetween. The registration device includes first and second registration gates for aligning the edges of the sheets, such that at least one edge of the content sheets is disposed inboard of the face sheets to define a peripheral edge. A controller positions the first and second registration gates from a registration position to a release position as the sheet material is laid upon the compiler tray. Finally, the multi-sheet stack is fed to the axial and radial deformation binding mechanisms to secure the peripheral edge of the multi-sheet stack to form mailpiece enclosure.

7 Claims, 7 Drawing Sheets

MULTI-SHEET IN-LINE DEFORMATION BINDING APPARATUS

RELATED APPLICATION

This invention is related to co-pending, commonly owned US publication number 2007/0017188 entitled "In-Line Deformation Binding Apparatus".

TECHNICAL FIELD

This invention relates to a method for fabricating a package such as a mailpiece, and more particularly, to a new and useful multi-sheet in-line apparatus for rapid and repeatable package fabrication.

BACKGROUND OF THE INVENTION

In the context of mailpiece delivery, a self-mailer is a term used for identifying mailpieces which employ some portion of its content information or material to form a finished mailpiece, i.e., a mailpiece ready for delivery. In addition to certain efficiencies gained from the dual use of paper stock, i.e., as both envelope and content material, self-mailers mitigate the potential for disassociation of content material from the mailing envelope, i.e., preventing mail from being delivered to an incorrect address.

In the simplest form, a self-mailer may include a single sheet of paper having printed communications or text on one side thereof and a mailing address on the other. The sheet is then folded and sealed to conceal the printed communications while causing the mailing address to remain visible. Postage evidence is applied to the face of the mailpiece in preparation for delivery either during the sheet printing operation or after mailpiece fabrication. This example simply shows that a self-mailer generally seeks to make dual use of the content material to both convey information while forming an envelope of a size and shape which is accepted by postal automation equipment. As such, the material and labor cost associated with combining content material with a container or envelope is minimized.

One such self-mailer includes flat mailpieces which are knurled along each edge of a four-sided rectangular mailpiece. These "flats", as they are frequently called, employ face sheets of paper stock which are oversized relative to the internal content material/sheets such that the peripheral edges thereof extend beyond the edges of the internal sheets on all four sides. The peripheral edges are then deformation bound along the entire length to capture and enclose the content material. Such deformation binding is a process wherein, following plastic deformation of the sheets, the elastic properties thereof develop mechanical forces at or along the interface, which forces are sufficient to bind the sheets together. Alternatively, or additionally, deformation binding may also be viewed as a process wherein the individual fibers of paper stock, upon the application of sufficient pressure/force, interleave or "hook" to form a mechanical interlock. As such, the content material and face sheets may be produced at a single workstation, stacked together and bound without the need for other handling processes i.e., such as folding of the content material or insertion of the content material into an envelope. Furthermore, and, perhaps more importantly, a self-mailer eliminates the requirement for consumable materials such as glue, staples or clips to form the enclosure or bind the edges.

Notwithstanding the potential benefits achievable by deformation binding, drawbacks principally to the binding efficiency or speed offer some explanation for its lack of widespread acceptance and use. For example, and referring to FIG. 1, the knurling wheels 100 of the prior art bind each pair of parallel edges 102*a*, 102*b* of a rectangular mailpiece 104 in a two step binding operation. More specifically, in a first operation, pairs of knurling wheels 100*a* deformation bind the edges 102*a* of the mailpiece 104 as the mailpiece travels in a first direction, indicated by arrow 106. In a second operation, pairs of knurling wheels 100*b* deformation bind the orthogonal edges 102*b* of the mailpiece 104 as the mailpiece travels in a second direction, indicated by arrow 108. The mailpiece 104 must come to a stop between each of the two binding operations and change direction, i.e., the second direction 108 is orthogonal relative to the first direction 106.

While the two step binding sequence described above may be suitable for fabricating mailpieces in small quantities, this manufacturing approach is less acceptable for fabricating large quantities of mailpieces. That is, the orthogonal redirection of the mailpiece slows fabrication sufficiently to render the process inappropriate for high-volume, high speed mailpiece fabrication.

Furthermore, the registration and alignment of content material requires exact placement to avoid deformation binding of the internal sheets in combination with the face sheets as the peripheral edges are bound. To avoid such difficulties, the face sheets are further enlarged, or content material undersized, to accommodate errors in the relative placement of the internal sheets. Notwithstanding such precautionary measures, shifting of the internal content material remains problematic until at least a portion of the stacked sheet material is deformation bound.

Additionally, and referring to FIG. 2*a*, the knurling wheels of the prior art produce a knurl pattern KP which tends to weaken the corners 110 of the bound mailpiece 104. That is, inasmuch as the knurling wheels deformation bind the mailpiece edges 102*a*, 102*b* along the entire edge, each linear pass causes an overlap in the corners thereby weakening the mailpiece 104, i.e., reducing its structural integrity, at the corners 110 thereof. While the binding operation could be controlled to avoid binding redundancy in the corner regions, i.e., by controlling the gap between each pair of knurling wheels at appropriate points along the linear travel, such control motion would require additional mechanical complexity and further reduce the speed of operation. With respect to the latter, it will be appreciated that the speed and complexity of operation will be adversely impacted by any non-continuous motion of the knurling wheels or transport deck.

Finally, while self-mailers do not necessarily require the use of consumable materials, such mailers typically employ prefabricated paper stock or specialty forms. That is, such mailers oftentimes incorporate unique glue lines, or windows cutout to facilitate fabrication or printing. As a result, their unique design does not facilitate or accommodate the use of conventional paper stock, i.e., common size and paper thickness/consistency. Consequently, while certain mailpiece fabrication costs are reduced, others, i.e., such as the prefabricated paper stock used in its fabrication, are greatly increased.

A need, therefore, exists for an efficient, high speed apparatus for fabricating packages having multiple sheets of content material which minimizes mechanical complexities, eliminates the use of consumable materials and facilitates fabrication using conventional paper stock.

SUMMARY OF THE INVENTION

An apparatus is provided for fabricating a multi-sheet package including a compiler, an axial deformation binding mechanism and a radial deformation binding mechanism which are in-line to pass sheet material along a linear feed path. Specifically, the compiler includes a sheet feeding apparatus and registration device for accepting multiple individual sheets of sheet material from the sheet feeding apparatus. The sheet feeding apparatus lays the sheet material onto a compiler tray of the registration device to form a multi-sheet stack having face sheets and content sheets disposed therebetween. The registration device further includes first and second registration gates for aligning edges of the face and content sheets, respectively, such that at least one edge of the content sheets are disposed inboard of an edge of the face sheets to define a peripheral edge. Furthermore, the first and second registration gates are positionable from a registration position to a release position as sheet material is laid upon the compiler tray. A controller controls the rate of sheet feed and the various operational positions, i.e., the release and registration positions, of the respective registration gates. Finally, the multi-sheet stack is fed to axial and radial deformation binding mechanisms to secure the content sheets between the face sheets of the multi-sheet stack to form an enclosure of the package.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION

The present invention describes an in-line system for fabricating a package such as a mailpiece having an enclosure for carrying content material. Generally, the packages described may be viewed as "self-mailers" inasmuch as face sheets may include content material, or may be stacked in combination with the content material, to form a finished package/mailpiece. The method may be performed without requiring the step of inserting content material into a prefabricated envelope as is typically done for many types of flats mailpieces. The address information for these typical flats mailpieces may be printed on the envelope or may be printed on the contents in a position viewable through a window in the envelope. While the present invention is described in the context of fabricating such package/mailpieces, it should be appreciated that the teachings of the invention are applicable to the fabrication of any package/mailpiece wherein deformation binding is a viable or acceptable method for enclosing the mailpiece.

Figure 3:
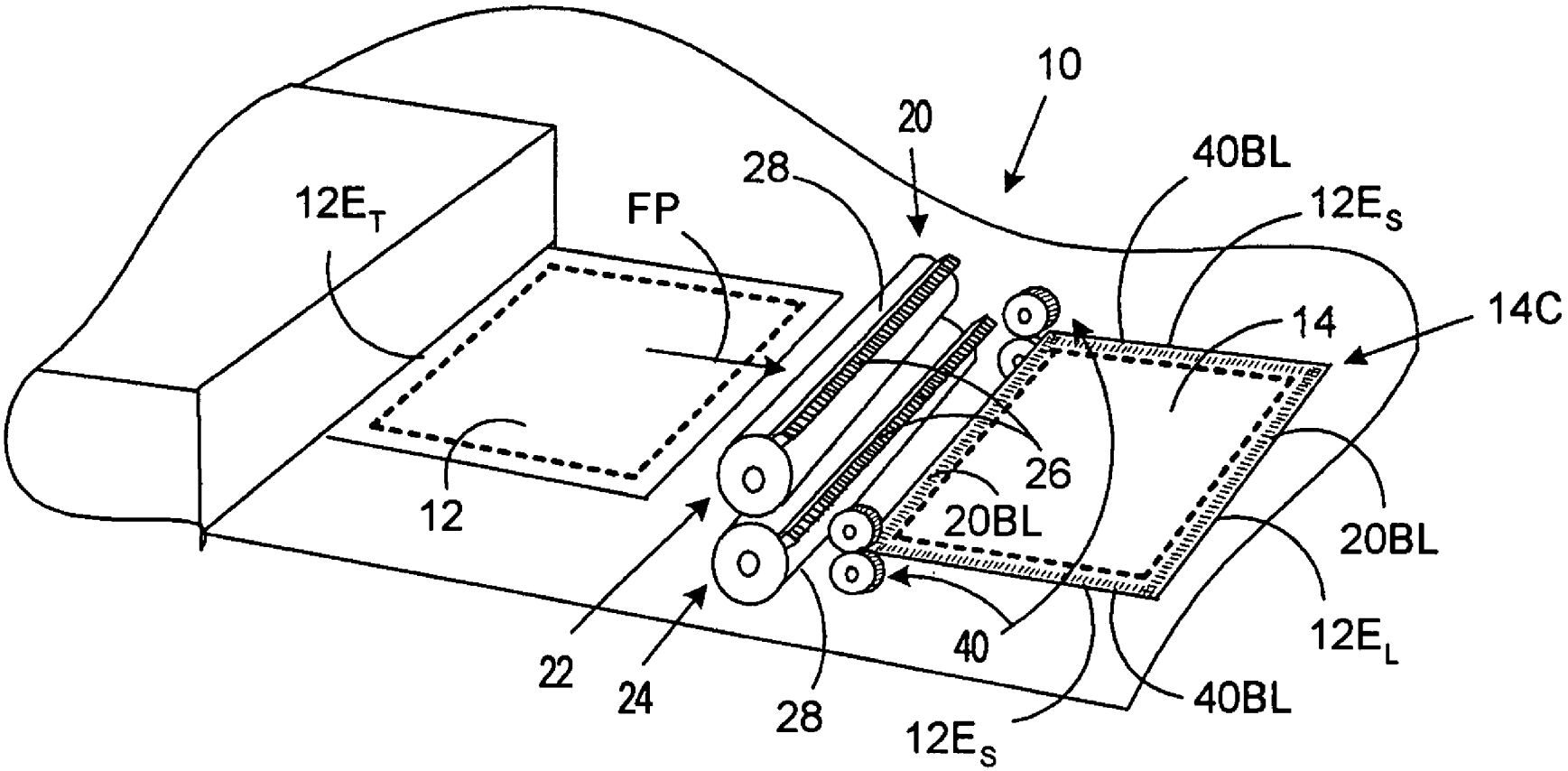
FIG. 3 is a schematic illustration of the relevant components of an apparatus according to the teachings of the present invention.
Figure 4:
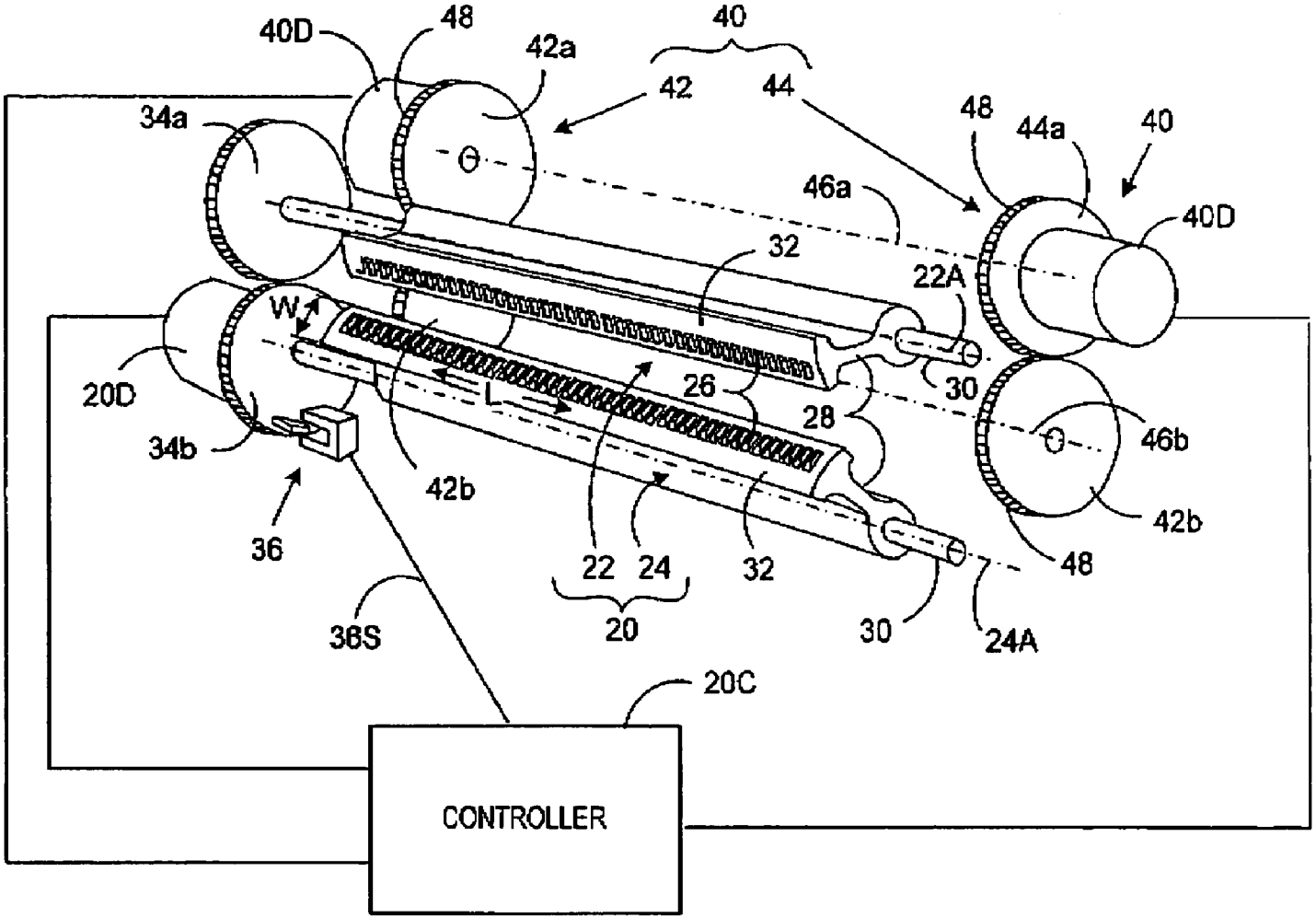
FIG. 4 is a schematic perspective illustration of an axial and radial deformation binding mechanism employed in the apparatus of the present invention.

Referring now to FIGS. 3 and 4, an in-line apparatus 10 comprises axial and radial binding mechanisms 20, 40 through which sheeted material 12 is passed to fabricate a mailpiece 14. The binding mechanisms 20, 40 are juxtaposed such that the sheet material 12 passes from one to the other of the binding mechanisms 20, 40 along a linear feed path FP (shown in FIG. 3) or single line of travel. Moreover, the binding mechanisms 20, 40 perform at least two binding operations which produce orthogonal bind lines. That is, one or more bind lines 20BL, 40BL are formed by each of the binding mechanisms 20, 40. The cooperation of each of the binding mechanisms 20, 40 together with a discussion of the detailed structural elements is provided in the subsequent paragraphs.

For the purposes of discussing the structural details of the binding mechanisms 20, 40, it will be presumed that the sheeted material 12 has been stacked, arranged and aligned in register in a condition suitable for acceptance by the in-line apparatus 10. In the described embodiment, a flat mailpiece 14 is produced, although the teachings of the present invention are useful for producing any mailpiece wherein it is desired to deformation bind the edges or portions thereof to enclose or capture content material. The sheet material 12 for producing the flat mailpiece 14 is rectangular in shape (i.e., a shape which is most compatible for use with automated postal equipment) and has oversized upper and lower face sheets which may extend beyond the internal content material. As such, the extended edges are contiguous and are deformation bound to each other without binding internal content material. As discussed in the Background of the invention, deformation binding is a familiar process wherein sheet stock is plastically deformed such that mechanical forces are developed along the interface to bind the sheets together. Such mechanical forces are believed to cause the individual fibers of paper stock to interlock, similar to hook and loop fasteners.

FIG. 4 shows an isolated perspective view of the relevant components of the axial and radial binding mechanisms 20, 40. The axial binding mechanism 20 includes a pair of rotating elements 22, 24 defining rotational axes 22A and 24A, respectively, and an axial array of opposed intermeshing teeth 26. More specifically, each of the rotating elements 22, 24 comprises an elongate radial support member 28 mounted upon and driven by a central shaft 30. The elongate radial member 28 has a substantially I-shaped cross-sectional configuration for structurally supporting the axial array of teeth 26 upon a top land portion 32 thereof.

The array of teeth 26 are substantially parallel to the respective rotational axes 22A, 24A, and rotationally indexed such that the teeth 26 intermesh at a predefined angular position of the radial support member 28. In the context used herein, "substantially" parallel, means that the array of teeth define a line which is within about ±5 degrees relative to the respective rotational axis 22A, 24A.

In the described embodiment, the rotating elements 22, 24 rotate through one or more complete revolutions, though the teeth 26 are operable to deformation bind through a relatively small angle thereof. That is, to deformation bind an edge of a mailpiece, the intermeshing teeth 26 may traverse a small arc, e.g., fifteen to twenty degrees (15-20 degrees), however, inasmuch as many applications will require deformation binding along at least two edges, e.g., leading and trailing edges, the rotating elements may rotate through two full revolutions per mailpiece. Generally, one full revolution will be required to deformation bind one edge of a mailpiece, and position the intermeshing teeth, i.e., to a "ready" position, to deformation bind a second edge of the same mailpiece. The rotation requirements and indexing aspects of the invention will be discussed in greater detail hereinafter when describing the function and operation of the in-line apparatus 10.

The rotating elements 22, 24 are spatially positioned to effect intermeshing engagement of the teeth 26, while leaving a small radial gap to enable the proper deformation or compaction forces to develop between the bound sheets 12. Generally, it will be desirable to develop uniform compaction forces, i.e., constant pressure, along the length of tooth engagement. While such uniform compaction forces may be attained by precision machining (i.e., by avoiding manufacturing deviations of sufficient magnitude to cause large pressure differences), other corrective measures which take into consideration the strength and/or properties of the materials can be employed. For example, depending upon the component inertia, modulus and/or stiffness of materials, it may be desirable to compensate for the anticipated flexure (i.e., under the compaction load) by outwardly "bowing" the center radial support member. Alternatively, the teeth 26 may be crowned to uniformly distribute the load. Notwithstanding, countermeasures which may be employed via machining, it may be desirable to incorporate an incremental adjustment mechanism (not shown) between the shafts 30 to increase or decrease the spatial separation between the rotational axes 22A, 24A. As such, the axial binding mechanism 20 may be adapted to a greater variety of applications, e.g., mailpieces using a greater or lesser number of pages to be bound, or using different thickness/type of paper stock.

While the radial support members 28 are shown to include a substantially I-shaped cross-sectional configuration for supporting the axial array of teeth 26, it will be appreciated that other configurations may be employed to structurally support the teeth 26. For example, the radial support members 28 may have a cylindrical cross-section defining a conventional roller for supporting the axial teeth 26 (similar to the schematic representation shown in FIG. 3). Moreover, while a single row of teeth 26 are shown, one associated with each radial support member, it will be appreciated that multiple rows of axial teeth 26 may be employed at various angular positions about the respective rotational axis 22A, 24A. A roller or cylindrically-shaped radial support member 28 may be best suited for this adaptation of the invention.

In the described embodiment, the axial array of teeth 26 is continuous, though it will be appreciated that the array may be continuous or discontinuous. For example, to avoid binding in a particular area of a mailpiece 14, it may be desirable to remove teeth 26 from a particular region or length of the radial support member. The axial array of teeth 26 lie in a common plane, i.e., are coplanar and define an aspect ratio, i.e., length L to width W, of at least two (2) and, preferably at least about five (5). The length L is the dimension along a line parallel to the respective rotational axes 22A, 24A and the width W is the circumferential dimension, i.e., arc length about the respective axes 22A, 24A. Furthermore, while the intermeshing teeth 26 are shown to include a conventional involute profile, i.e., having the shape of a common gear tooth, the teeth 26 may have any of a variety of shapes provided that the teeth 26 protrude radially outboard of the respective rotational axis 22A, 24A, and intermesh with respect to the opposed array of teeth 26. It will generally be desirable to optimize the profile of the teeth 26 based upon specific types and thicknesses of anticipated media material to be deformation bound.

The teeth 26 are driven about their respective axes 22A, 24A, by a drive actuator 20D. In the described embodiment, the shafts 30 are rotationally coupled by a pair of spur gears 34*a*, 34*b* of equal root diameter. The drive actuator 20D may be co-axially aligned with and drive one of the spur gears 34*b*, which, in turn, drives the other spur gear 34*a* such that both elements 22, 24 counter rotate. Inasmuch as the spur gears 34*a*, 34*b* are equal in root diameter, the rotating elements 22, 24 of the axial binding mechanism 20 rotate at the same rotational speed to index the teeth 26 into meshing engagement. To control the rotational speed, or position the teeth 26 relative to an edge of the sheet material 12, it may be desirable to include a position/home sensor 36 coupled to one of the spur gears 34*a*, 34*b*. An output signal 36S of the position/home sensor 36 may be received by a controller 20C for controlling the stop or home position of the drive actuator and, consequently, the axial deformation mechanism 20. As such, the controller 20C may index and/or position the teeth 26 with the arrival of the leading or trailing edge of the sheet material 12.

The radial binding mechanism 40 includes two pairs of rotating discs 42, 44 wherein discs 42*a*, 44*a*, rotate about a first axis, 46*a*, and discs 42*b*, 44*b* rotate about a second axis 46*b*. The rotating discs 42, 44 further comprise a plurality of intermeshing teeth 48 projecting radially from one of the parallel axes 46*a*, 46*b* and substantially orthogonal thereto. In the context used herein, "substantially" orthogonal, means that the teeth 48 are oriented at an angle of about in about ±5 degrees relative to the respective rotational axes 46*a*, 46*b*.

The discs 42*a*, 42*b*, 44*a*, 44*b* of each pair are spatially positioned to effect intermeshing engagement of the teeth 48, while leaving a small radial gap to enable the proper deformation or compaction forces to develop between the bound sheet material. 12. In the described embodiment, the array of radial teeth 48 are continuous about the periphery of the discs 42*a*, 42*b*, 44*a*, 44*b*, i.e., fill the periphery, though it will be appreciated that the array of radial teeth 48 may be discontinuous so as to only occupy a segment of the periphery For example, to avoid deformation binding over a particular length of the mailpiece 14, it may be desirable to form teeth 48 about a portion of the disc circumference, e.g., two-hundred and seventy (270) degrees of the disc circumference, thereby leaving a small portion of the bind line 48 unbound. That is, the portion corresponding to the ninety (90) degree arc absent or void of binding teeth 48. Similar to the axial binding mechanism 20, the teeth 48 may have any of a variety of shapes provided that the teeth 48 project radially outboard of the rotating discs 42, 44 and intermesh to deformation bind the sheet material 12.

In operation, the sheet material 12 is drawn through each of the binding mechanisms 20, 40 to deformation bind its edges and, at least partially, enclose any content material between the face sheets of the stacked sheet material 12. More specifically, the rotating elements 22, 24 of the axial binding mechanism 20 deformation bind a leading edge 12$E_L$ of the sheet material 12 along the first bind line 20BL. The motion of the axial binding mechanism 20 feeds the sheet material 12 along a unidirectional path FP to each of the radial binding mechanisms 40. Alternatively, driving rollers (not shown) or other drive devices may transport the sheet material 12 to the radial binding mechanism 40. The radial binding mechanism 40 is disposed at locations corresponding to orthogonal or side edges 12$E_S$ of the sheet material 12. As the discs 42, 44 are rotationally driven, the side edges 12$E_S$ of sheet material 12 are deformation bound. As such, second bind lines 40BL are formed, orthogonal to the first bind line 20BL to, at least partially, enclose the sheet material 12.

Following the radial binding operation, the sheet material 12 may be deformation bound along a trailing edge 12$E_T$ by the axial binding mechanism 20. More specifically, the rotating elements 22, 24 are indexed or synchronously rotate through a three-hundred and sixty (360) degree arc or angle to deformation bind the trailing edge 12$E_T$ of the sheet material 12. As such, all edges, i.e., leading, trailing and side edges 12$E_L$, 12$E_S$, 12$E_T$, of the sheet material 12 are deformation bound to form a completed mailpiece 14 (see FIG. 3).

Figure 1:
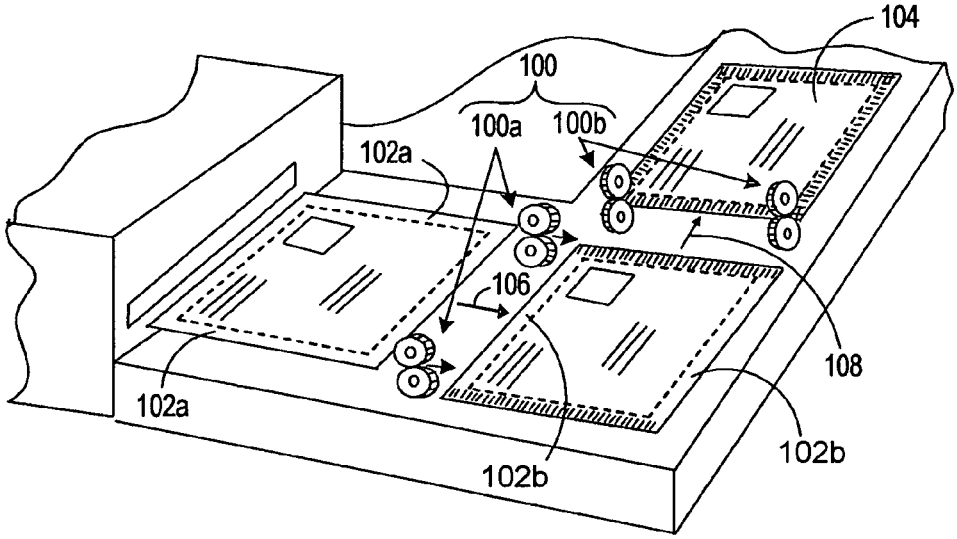
FIG. 1 ( PRIOR ART )
FIG. 1 is a schematic illustration of a prior art deformation binding system which employs pairs of knurling wheels for binding the edges of a flat rectangular mailpiece.
Figure 2A:
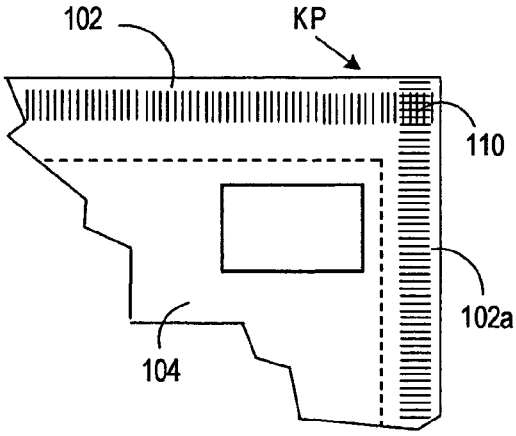
FIG. 2a ( PRIOR ART )
FIG. 2*a* depicts the knurling pattern produced by a prior art deformation binding system, and specifically, the knurling pattern produced in a corner region of a mailpiece.
Figure 2B:
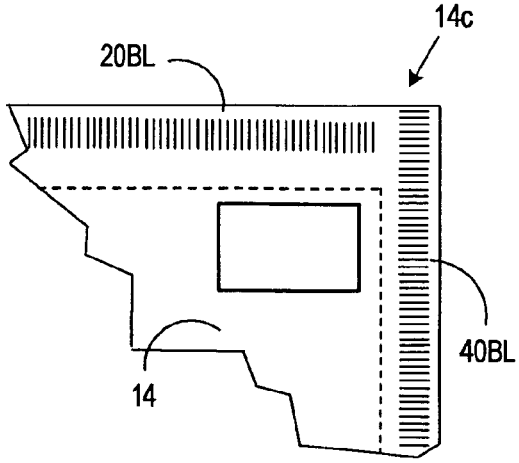
FIG. 2*b* depicts the deformation binding pattern produced by an in-line apparatus of the present invention and, specifically, the binding pattern produced in a corner region of a mailpiece.

It should also be appreciated that the deformation binding operations performed by the axial and radial binding mechanisms 20, 40 can be configured to avoid weakness in the corner of the finished mailpiece 14. In FIG. 2*b*, the bind line 20BL formed by the axial binding mechanism 20 may be shortened, i.e., the axial teeth 26 may not span the entire length of the mailpiece 14, so as not to overlap or interfere with the bind line 40BL formed by the radial binding mechanism 40. Alternatively, it may be desirable to omit a segment of teeth 48 on the periphery of the discs 42*a*, 42*b*, 44*a*, 44*b*, of the radial binding mechanism 40 such that when approaching a corner region 14C, the teeth 48 do not intermesh. In this embodiment, the teeth 26 of the axial binding mechanism 20 may span the entire length of the leading and trailing edges 12$E_L$, 12$E_T$, while the radial binding mechanism 40 deformation binds the side edges 12$E_S$ in areas between the corner regions 14C. As such, the structural integrity of the mailpiece 14 is maintained in the corner regions 14C.

Figure 5A:
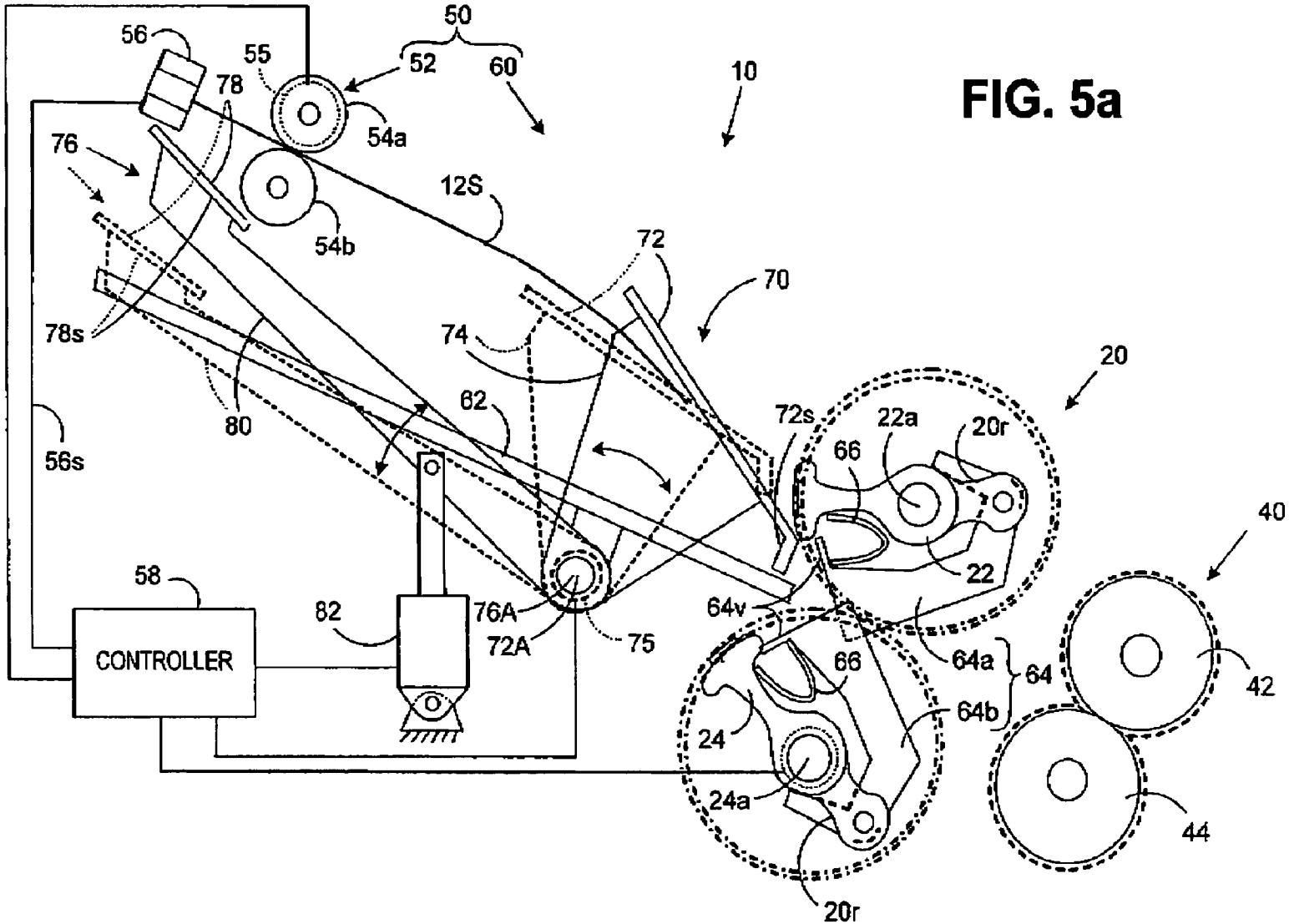
FIGS. 5*a*-5*f* depict side views of the apparatus showing various operating positions of a sheet feeding apparatus and registration device for stacking multiple sheets of material in preparation for conveyance to the axial and radial deformation binding mechanisms shown in FIG. 4.
Figure 5B:
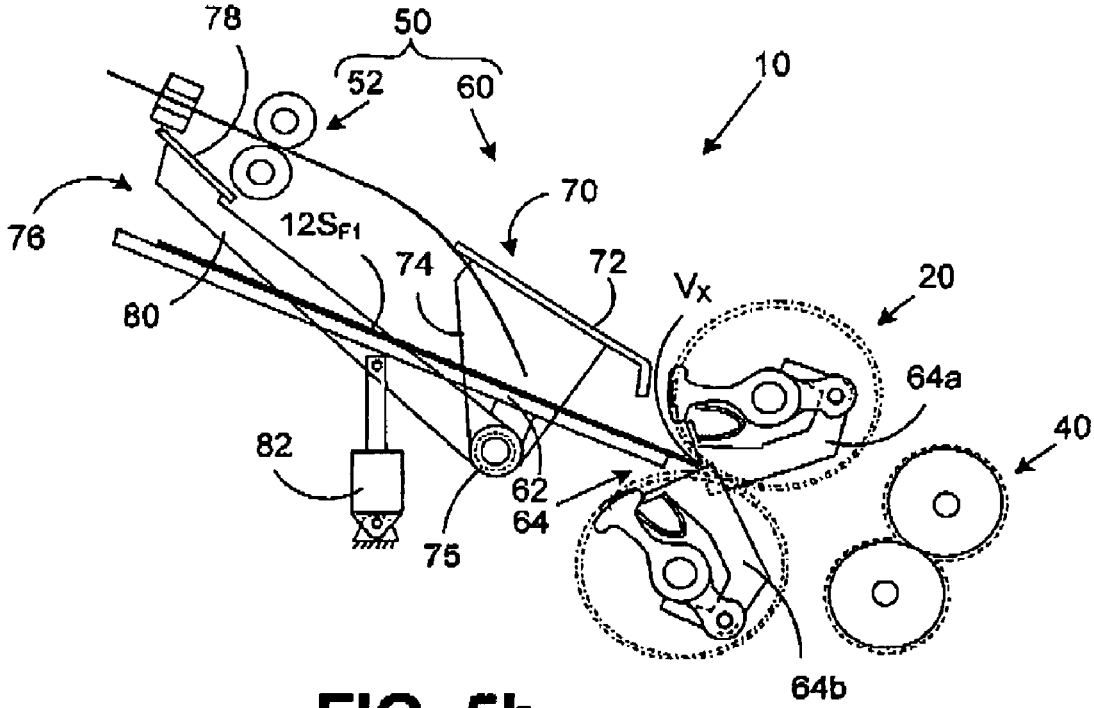
Figure 5C:
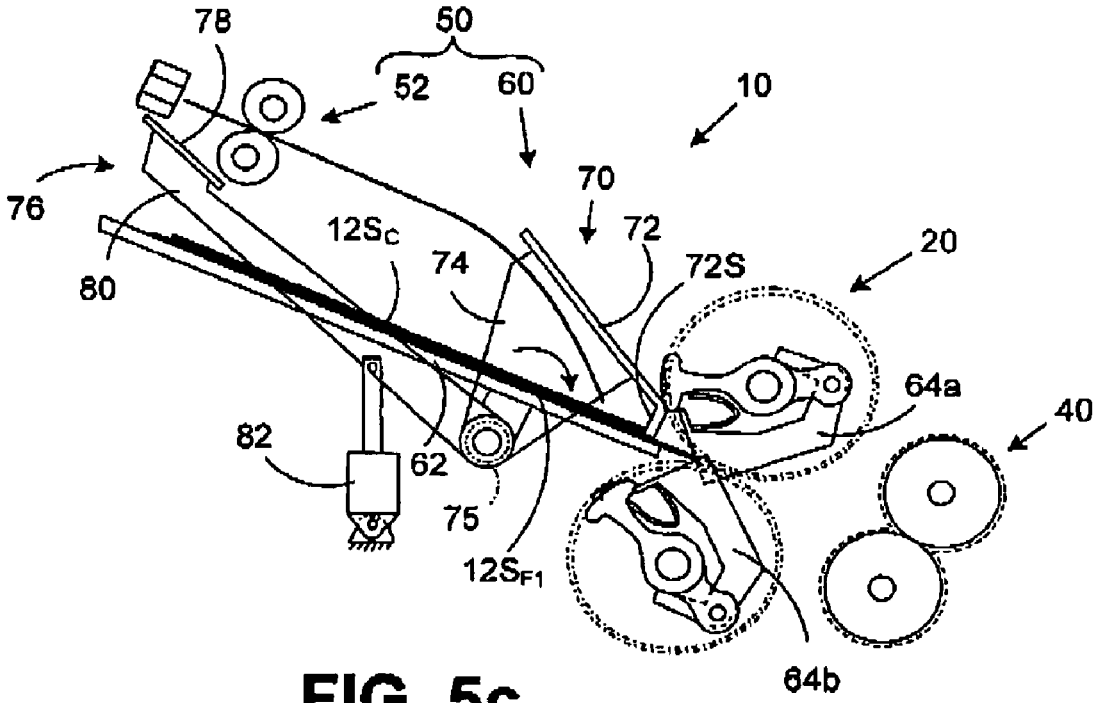

Whereas, in the foregoing discussion, the sheet material 12 was stacked and aligned for presentation to the binding mechanisms 20, 40, the following describes a compiler 50 for preparing and delivering the multi-sheet stack 12 to the binding mechanisms 20, 40. Referring to FIG. 5*a*, the compiler 50 includes a sheet feeding apparatus 52 and a registration device 60 which cooperate to compile and align individual sheets 12*s* of material. The sheet feeding apparatus 52 includes input drive rollers 54*a*, 54*b*, a drive actuator 55 rotationally coupled to and driving one of the input drive rollers 54*a*, 54*b*, a trailing edge sensor 56 and a controller 58 for varying the speed of a drive actuator 55. More specifically, the sheet feeding apparatus 50 delivers individual sheets 12*s* of material to a compiler tray 62 of the registration device 60 by the input drive rollers 54*a*, 54*b*. The speed of the driver rollers 54*a*, 54*b* is variably controlled by the trailing edge sensor 56 which provides a feedback signal 56S indicative of the feed rate of the sheet 12*s* to the speed controller 58. In a closed feedback loop, the controller 58 varies the speed of the actuator 55 for driving the rollers 54*a*, 54*b*.

Briefly explained, it is generally desirable to maximize the speed of the drive rollers 54*a*, 54*b* when feeding a first length of sheet material 12*s* while decreasing the speed to a threshold value immediately prior to release of the sheet 12*s*. The reason for such speed control relates to the momentum of an individual sheet 12*s* which, if too high, can cause the sheet 12*s* to rebound from, and become misaligned with respect to, a registration surface. By decreasing the rotational speed, immediately prior to the release of the sheet 12*s*, the speed and momentum is reduced to alleviate misalignment problems while, at the same time, maximizing the feed rate of sheet compilation. That is, rather than maintaining the speed of the drive rollers 54*a*, 54*b* at a constant slow rate to avoid misalignment, the speed is variably controlled, e.g., a high rate over, for example, two-thirds of the sheet length and a slower rate over a final one-third of the sheet length to optimize the median rate of sheet delivery.

The compiler tray 62 receives each sheet 12*s* from the sheet feeding apparatus 50 while various other components of the registration device 60 align, stack and restrain the sheet material 12. In addition to the compiler tray 62, the registration device 60 includes a face sheet registration gate 64, a content sheet registrationgate 70 and a clamping device 76. In the described embodiment, the face sheet registration gate 64 includes a pair of opposing abutment members 64*a*, 64*b* each being pivotally mounted to a radial arm 20R of the axial binding mechanism 20. The abutmentmembers 64*a*, 64*b* are staggered axially along the rotational axes 22*a*, 24*a*, to form a converging V-shaped registration surface 64V. Furthermore, each abutment member 64*a*, 64*b* is spring biased by a U-shaped spring member 66 to a registration position and may be rotationally displaced against the force of the spring member 66 to a release position upon rotation of the axial binding mechanism 20. The various positions and rotational displacement of the abutment members 64*a*, 64*b* will be discussed in greater detail when discussing the combined operation of the registration device 60 and the axial binding mechanism 20.

The content sheet registration gate 70 includes an L-shaped registration plate 72 pivotally mounted to the compiler tray 62 by a swing-arm 74. The registration plate 72 further includes a linear registration surface 72S and is pivotable from a registration position (shown in solid lines in FIG. 5*a*) to a released position (shown in dashed lines in FIG. 5*a*). A rotary actuator 75 is operable to rotate the swing-arm 74 and registration plate 72 about a pivot axis 72A disposed beneath the compiler tray 62.

The clamping device 76 includes a clamping plate 78 pivotally mounted to the compiler tray 62 by an elongate swing-bar 80. The clamping plate 76 further includes a clamping surface 78*s* and is pivotable from an open position (shown in solid lines in FIG. 5*a*) to a restraint position (shown in dashed lines in FIG. 5*a*). In the described embodiment, an actuator 82 is operable to rotate the swing-bar 80 and clamping plate 78 about a pivot axis 76A disposed beneath the compiler tray 62. While the pivot axes 72A, 76A of the registration and clamping plates 72, 78, respectively, are co-axially aligned and disposed below the compiler tray 62, it should be appreciated that the pivot axes 72A, 76A need not be co-axial and may be disposed at any suitable location to rotate the plates 72, 78, into and out of their respective operating positions. Additionally, the registration gate and clamping device 70 and 76. respectively may be mechanically linked, and driven simultaneously from the release/open to registration/restraint positions by a single actuator 75, thereby eliminating actuator 82.

In operation, and referring to FIGS. 5*b*-5*f*, the content sheet registration gate 70 and clamping device 76 are initially in their release and open positions, respectively so that the sheet feeding apparatus 52 may deliver a first face sheet 12$S_{F1}$ to the compiler tray 62. When released, a forward edge of the first face sheet 12$S_{F1}$ is disposed in register with the V-shaped registration surface 64V of the opposing abutment members 64*a*, 64*b*. The V-shape of the registration surface 64V serves to guide and converge the forward edge of the face sheet 12$S_{F1}$ to the vertex VX formed by the abutment members 64*a*, 64*b*.

With the first face sheet 12$S_{F1}$ in position, the rotary actuator 75 causes the cover sheet registration gate 70 to rotate in a clockwise direction (based on the left side view illustrated in FIG. 5*c*) to its registration position. As such, the registration plate 72 is contiguous with (i.e. rests on the top surface of) the first face sheet 12$S_{F1}$ and the registration surface 72S is inboard of the forward edge thereof. With the content sheet registration gate 70 in its registration position, the required content sheets $12S_C$ are advanced onto the compiler tray 62. As such, the forward edges of the content sheets $12S_C$ are collectively aligned in register with the linear registration surface 72S.

Figure 5D:
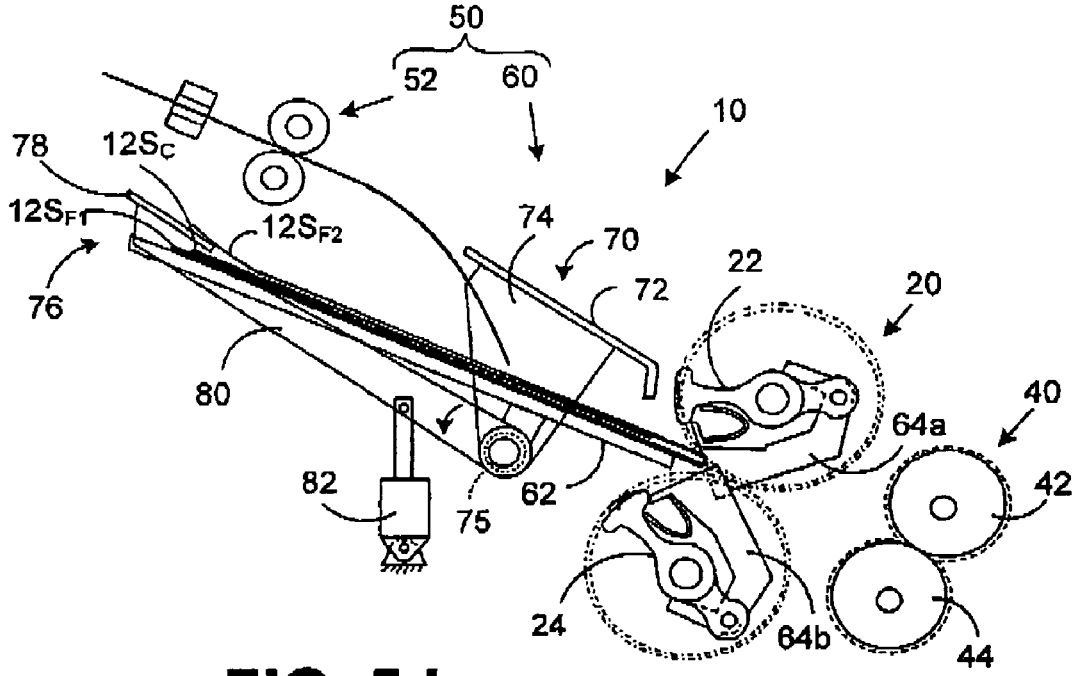

When all content sheets $12S_C$ have been laid onto the compiler tray 62, the linear actuator 82 causes the clamping device 76 to rotate from its open to its restraint position as seen in FIG. 5*d*. As such, the clamping plate 80 contacts the uppermost or top content sheet $12C_S$ to restrain the laid sheets 12S in the in preparation for receipt of the second or final face sheet $12S_{F2}$. Furthermore, the rotary actuator 75 effects rotation of the content sheet registration gate 70 in a counter clockwise direction. As such, the registration gate 70 rotates from its registration to release position thereby enabling the second face sheet $12S_{F2}$ to abut and align with the V-shape registration surface 64V of the face sheet registration gate 64.

Figure 5E:
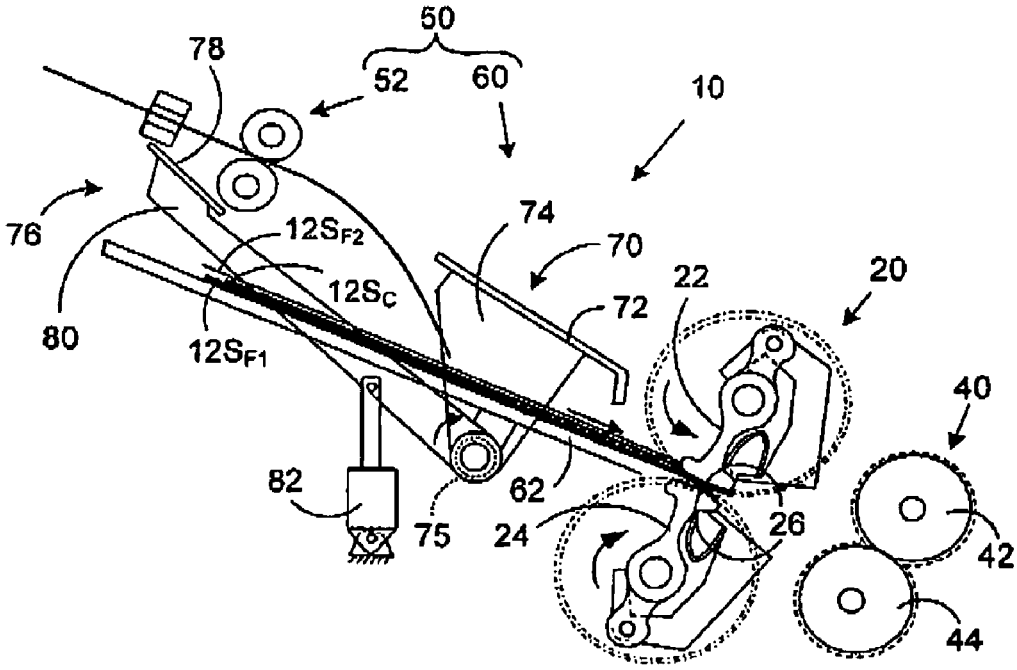

In FIG. 5*e*, the linear actuator 82 extends to rotate the clamping plate 80 to its open position thereby releasing the all sheets $12S_{F1}$, $12S_C$, $12S_{F2}$ laid on the compiler tray 62. At the same time and with the first and second face sheets $12S_{F1}$, $12S_{F2}$ aligned, the rotating elements 22, 24 of the axial binding mechanism 20 rotate to capture the face sheets $12S_{F1}$, $12S_{F2}$ between the axial teeth 26 thereof in order to deformation bind the sheets together.

Figure 5F:
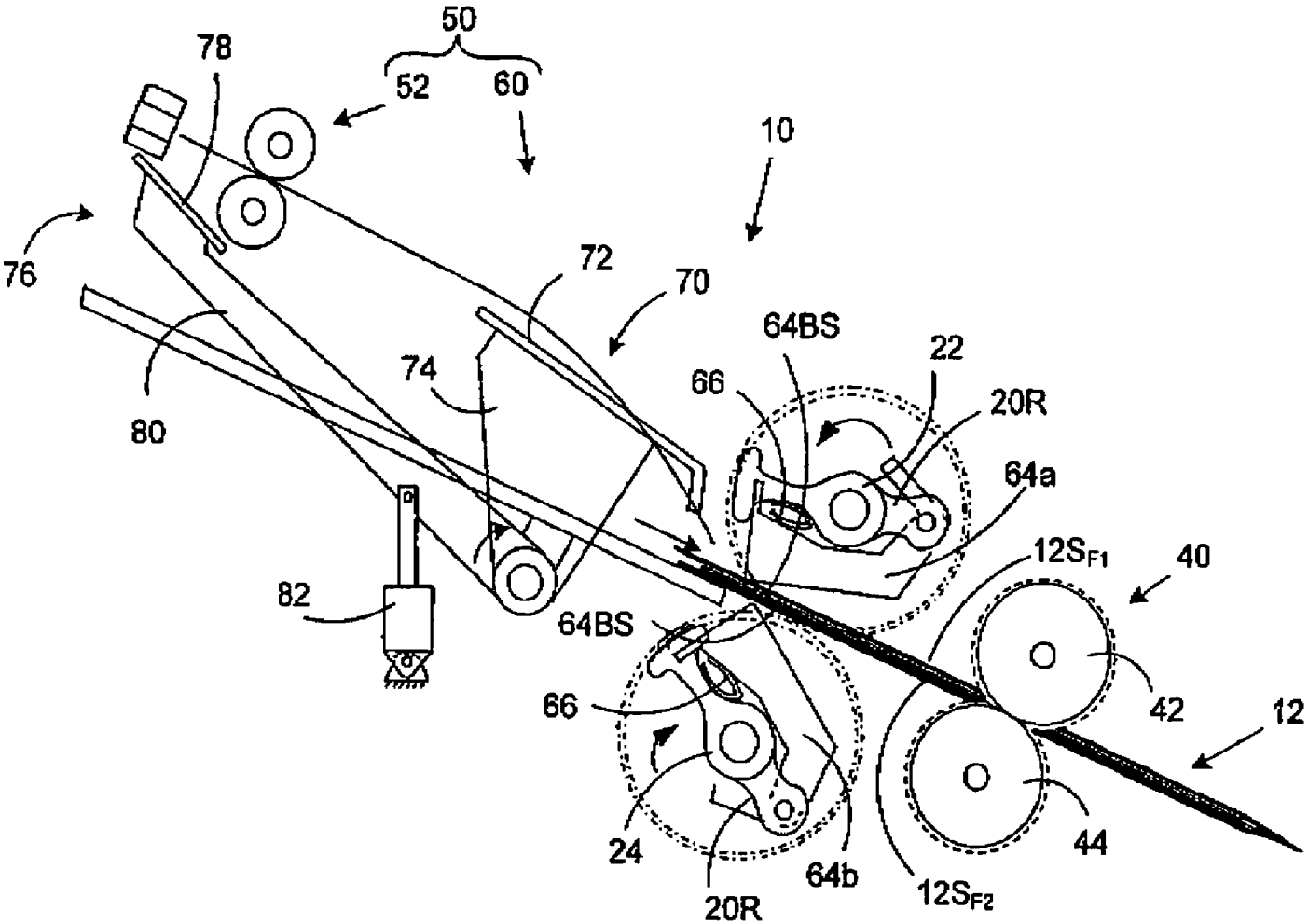

The operation of the binding mechanisms 20, 40 has been discussed in preceding paragraphs and will not be further discussed except that the staggered abutment members 64*a*, 64*b* must pivot to a radially inboard position to permit the rotating elements 22, 24 of the axial binding mechanism 20 to traverse a full revolution, i.e., through a full three-hundred and sixty (360) degrees of rotational motion. In FIG. 5*f*, as the rotating elements 22, 24 rotate to deformation bind the trailing edge of the stacked sheet material 12, it will be appreciated that the abutment members 64*a*, 64*b* must rotate from their initial registration position to a release position to avoid binding with the sheet material 12. More specifically, a backside surface 64BS of each of the abutment members 64*a*, 64*b* contacts the face sheets $12S_{F1}$, $12S_{F2}$ to cause each of the abutment members 64*a*, 64*b* to pivot radially inboard against the spring bias force of the spring members 66. As such, the rotating motion of the axial binding mechanism 20 in combination with the passing sheet material 12 causes the face sheet registration gate 64 to assume its release position. This configuration eliminates the need for an actuator, similar to this required for positioning the content sheet registration gate 70 and clamping device 80.

While the face sheet registration gate 64 of the registration device 60 is shown in combination with the axial binding mechanism 20, it should be appreciated that the registration gate may be disposed in combination with the compiler tray 62 in a fashion similar to the content registration gate 70 or the clamping device 76. For example, the compiler tray 62 may include a pivotable shelf or shoulder (not shown) proximal to the axial teeth 26 of the axial deformation binding mechanism 20 to form a registration surface suitable to align the edges of the face sheets $12S_{F1}$, $12S_{F2}$. The shelf would be rotated to a position perpendicular to the deck of the compiler tray in its registration position and rotated to a coplanar position in its release position. A rotary actuator, similar to those described in connection with the content sheet registration gate, would rotationally displace the shelf about its hinge axis. Additionally, the actuator may be controlled or actuated by the controller 58. In such embodiment, it may be necessary to drive the multi-sheet stack to the axial deformation binding mechanism, i.e., due to the location and space required to rotate the shelf into and out of position.

Furthermore, while the compiler 50 is shown in combination with both axial and radial deformation binding mechanisms 20, 40, the compiler 50 may be used with one or both depending upon the peripheral edges, $12E_L$, $12E_T$, $12E_S$ which may be bound. For example, it may be desirable to deformation bind only the leading and trailing edges of the finished mailpiece 14, hence, the need for a radial deformation binding mechanism may be eliminated. Alternatively, it may be desirable to deformation bind only the side edges of the finished mailpiece 12, hence, an axial deformation binding mechanism may be unnecessary.

In summary, the apparatus 10 of the present invention includes a compiler and one or more deformation binding mechanisms which are in-line to convey sheet material along a linear feed path. As such, the multi-sheet apparatus eliminates the stopping/starting operations or directional changes commonly employed in prior art apparatus. Consequently, the multi-sheet apparatus 10 reduces noise and increases reliability. The method may be performed without requiring the step of inserting content material into a prefabricated envelope as is typically done for many types of flats mailpieces. The address information for these typical flats mailpieces may be printed on the envelope or may be printed on the contents viewable through a window in the envelope.

Furthermore, the axial binding mechanism 20 of the apparatus 10 provides an opportunity to deformation bind entire edges, i.e., without significant travel of the sheet material 12. As a result, the speed of operation may be enhanced. At the same time, portions of the linear array of teeth may be modified, shortened or discontinuous to avoid overlapping with the bind line produced by the radial binding mechanism. Consequently, the structural integrity of the mailpiece may be maintained despite the orthogonal relationship of the bind lines.

Finally, the multi-sheet apparatus 10 enables each bind line to be formed by deformation binding rather than one which may combine various sealing methods, e.g., via gluing/stapling in combination with deformation binding in one direction. As a result, a mailpiece is created without requiring consumable sealing materials.

It is to be understood that the present invention is not to be considered as limited to the specific embodiments described above and shown in the accompanying drawings. For example, while both axial and radial deformation binding , which merely illustrate the best mode presently contemplated for carrying out the invention, and which is susceptible to such changes as may be obvious to one skilled in the art, but rather that the invention is intended to cover all such variations, modifications and equivalents thereof as may be deemed to be within the scope of the claims appended hereto.

What is claimed is:

1. An apparatus for preparing a multi-sheet stack of sheet material to fabricate a package, comprising:

a compiler including a sheet feeding apparatus and a registration device, the sheet feeding apparatus feeding multiple sheets of material to the registration device, the sheet material being laid to form the multi-sheet stack, the multi-sheet stack having first and second face sheets and content sheets disposed therebetween, and the registration device including:

a compiler tray for accepting and supporting multi-sheet stack from the sheet feeding apparatus, a first registration gate for aligning leading edges of the first and second face sheets of the multi-sheet stack to define a peripheral edge portion of the multi-sheet stack, the first registration gate having first and second abutment members disposed proximal to an edge of the compiler tray and positionable from a registration position to a release position, a second registration gate for aligning leading edges of each of the content sheets of the multi-sheet stack, the leading edges of each of the content sheets being disposed inboard of the peripheral edge portion, the second registration gate proximal to an edge of the compiler tray and positionable from a registration position to a release position, and a controller for controlling the sheet feeding apparatus and operative to displace the first and second registration gates into the respective registration positions as the sheets are placed onto the compiler tray, and to displace the second registration gate into its release position when aligning the edge of the second face sheet to complete a lay-up of the multi-sheet stack, and an axial deformation binding mechanism for deformation binding the peripheral edge portion of the multi-sheet stack and including first and second rotating elements each having a rotational axis, the first and second abutment members of the first registration gate each being pivotally mounted to one of the first and second rotating elements of the axial deformation binding mechanism, and being staggered axially along the rotational axes of the first and second rotating elements to form a V-shaped registration surface.

2. The apparatus according to claim 1 wherein the sheet feeding apparatus includes:

first and second input drive rollers for delivering individual sheets of the sheet material, a drive actuator rotationally coupled to and driving the first and second input drive rollers, a trailing edge sensor for providing a feedback signal indicative of the feed rate of the first and second face sheets and content sheets; and a speed controller, responsive to the feedback signal, for variably controlling the speed of the drive actuator.

3. The apparatus according to claim 1 wherein second registration gate includes a registration plate pivotally mounted to the compiler tray.

4. The apparatus according to claim 3 wherein the registration plate includes a registration surface for aligning the content sheets and is contiguous with the first face sheet to retain the first face sheet when the content sheets are aligned with the registration surface.

5. The apparatus according to claim 1 further comprising a clamping device repositionable from a restraint position to an open position, the controller operative to displace the clamping device into the restraint position for retaining the multi-sheet stack when the second registration gate is in the release position and operative to displace the clamping device into the open position to release the multi-sheet stack.

6. The apparatus according to claim 5 wherein the clamping device includes a clamping plate pivotally mounted to the compiler tray, the clamping plate engaging a trailing edge portion of the sheets in its restraint position.

7. The apparatus according to claim 1 further comprising a spring member interposing each of the first and second rotating elements and each of the first and second abutment members, the spring member producing a spring bias force to bias each of the first and second abutment members into its registration position, and wherein rotational displacement of the first and second rotating elements causes the first and second abutment members to pivot against the spring bias force to cause the first registration gate to change position from its registration position to its release position.

* * * * *